United States Patent [19]

Barwise

[11] Patent Number: 4,956,077

[45] Date of Patent: Sep. 11, 1990

[54] FROTH FLOTATION OF MINERAL FINES

[75] Inventor: Christopher H. Barwise, Buddle Hill

[73] Assignee: Fospur Limited, Somercotes, England

[21] Appl. No.: 260,615

[22] Filed: Oct. 21, 1988

[30] Foreign Application Priority Data

Nov. 17, 1987 [GB] United Kingdom ..... 8726857

[51] Int. Cl.[5] ..... B03D 1/02

[52] U.S. Cl. ..... 209/166; 209/5; 252/61

[58] Field of Search ..... 209/166, 167, 901; 252/61; 423/26

[56] References Cited

U.S. PATENT DOCUMENTS

| | | | |
|---|---|---|---|
| 1,530,496 | 3/1925 | Isham | 209/166 |
| 2,424,402 | 7/1947 | Loane | 209/166 |
| 2,611,485 | 9/1952 | Tueter | 209/166 |
| 2,740,522 | 4/1956 | Aimone | 209/167 |
| 3,138,550 | 6/1964 | Woolery | 209/166 |
| 4,126,426 | 11/1978 | Verchuur | 209/5 |
| 4,248,697 | 2/1981 | Halvorsen | 209/5 |
| 4,253,614 | 3/1981 | McGarry | 209/166 |
| 4,270,926 | 6/1981 | Burk, Jr. | 209/166 |
| 4,304,573 | 12/1981 | Burgess et al. . | |
| 4,326,855 | 4/1982 | Cottell | 209/5 |
| 4,330,667 | 5/1982 | Job | 209/166 |
| 4,340,467 | 7/1982 | Wang | 209/166 |
| 4,415,337 | 11/1983 | Kutta | 44/24 |
| 4,437,861 | 3/1984 | Ishizuka et al. . | |
| 4,448,585 | 5/1984 | Yoo | 209/166 |
| 4,466,887 | 8/1984 | Gross . | |
| 4,526,680 | 7/1985 | Owen | 209/166 |
| 4,532,032 | 7/1985 | Ng et al. . | |
| 4,564,369 | 1/1986 | Burgess | 44/2 |
| 4,589,980 | 5/1986 | Keys | 252/61 |
| 4,618,414 | 10/1986 | Hartan et al. . | |
| 4,690,752 | 9/1987 | Shaw | 209/167 |
| 4,859,318 | 8/1989 | Brookes | 209/166 |

FOREIGN PATENT DOCUMENTS

| | | | |
|---|---|---|---|
| 23073 | 6/1972 | Australia . | |
| 47200 | 4/1974 | Australia | 209/167 |
| 1201223 | 2/1986 | Canada . | |
| 0020275 | 12/1980 | European Pat. Off. . | |
| 0164237 | 1/1986 | European Pat. Off. . | |
| 166897 | 1/1986 | European Pat. Off. . | |
| 2456104 | 11/1973 | Fed. Rep. of Germany | 209/166 |
| 2175174 | 3/1972 | France | 209/166 |
| 104569 | 1/1979 | Poland . | |
| 732018 | 5/1980 | U.S.S.R. . | |
| 679909 | 9/1952 | United Kingdom | 209/166 |
| 953550 | 3/1964 | United Kingdom . | |
| 957724 | 5/1964 | United Kingdom . | |
| 996220 | 6/1965 | United Kingdom | 209/166 |
| 1041547 | 9/1966 | United Kingdom . | |
| 1110643 | 4/1968 | United Kingdom . | |
| 2111866A | 7/1983 | United Kingdom . | |
| 2171929A | 9/1986 | United Kingdom . | |
| 2156243B | 4/1987 | United Kingdom . | |
| 2157980B | 4/1987 | United Kingdom . | |
| 2182587A | 5/1987 | United Kingdom . | |
| 2163976B | 9/1988 | United Kingdom . | |

OTHER PUBLICATIONS

Littlefair, et al. "On the Selective Flocculation of Coal Using Polystyrene Latex", Intl Jour. of Mineral Processing, 17 (1986), pp. 187–203.

Brookes, et al. "The Selective Flocculation of Coal/-Shale Mixtures Using . . . ", XIV Intl Min. Processing Cong., Oct. 17–23, 1982, pp. VII–7.1–VII–7.17.

*Primary Examiner*—David L. Lacey

*Assistant Examiner*—Thomas M. Lithgow

*Attorney, Agent, or Firm*—Nixon & Vanderhye

[57] ABSTRACT

Particles of a desired mineral are recovered from particles of an unwanted mineral in an aqueous slurry by a froth flotation process in which, after treatment of the mineral particles with a collector, a predominantly hydrophobic polymeric flocculating agent, which will selectively flocculate the desired mineral particles, is added to the slurry. The predominantly hydrophobic polymeric flocculating agent may be for example a polyvinyl ether or a polybutadiene and may be predispersed in a carrier liquid, which may be the frother used to produce the froth.

16 Claims, No Drawings

FROTH FLOTATION OF MINERAL FINES

This invention relates to the beneficiation of fine mineral particles by froth flotation.

The surface of particles of most minerals is hydrophilic. The well-known froth flotation method of separating mineral particles involves first treating the particles in an aqueous suspension with a surface active chemical compound, known as a "collector", so as to render the surface of the particles hydrophobic, so that it is attracted to air rather than water, adding a so-called "frother" to enable a froth of the required stability to be produced, and then aerating the aqueous suspension so that the mineral which it is desired to recover is recovered in the froth so-formed.

The largest particle present within a mass of mineral particles which are to be separated by froth flotation must be of a size such that the desired mineral particles will be physically released from unwanted mineral particles and that the mass of each of the desired mineral particles does not exceed its force of attraction to an air bubble under the conditions of turbulence occurring in the aqueous suspension of mineral particles.

It is therefore necessary to grind minerals so that the particles are sufficiently small for separation by an industrial froth flotation process. During the grinding process it is inevitable that some of the particles produced will be finer than intended and particles of the desired mineral which are too fine are generally difficult to recover by froth flotation. The size at which the difficulty is met will depend on a number of factors, including the specific gravity of the mineral which it is desired to recover, the degree of turbulence within the aqueous suspension of mineral particles and the size range of the air bubbles in the suspension. Commonly, recovery of the desired mineral and rejection of unwanted minerals starts to deteriorate when the mineral particles are finer than about 10 microns, becoming very poor when the particles are finer than about 1 micron. These difficulties are commonly referred to as sliming problems.

It has now been found that the difficulty of recovering these excessively fine particles of the desired mineral can be overcome if during the froth flotation process the mineral particles are treated with a flocculant which selectively flocculates the particles of the desired mineral or minerals in preference to the unwanted mineral particles.

According to the invention there is provided a process for the beneficiation of mineral particles in which particles of a desired mineral and particles of an unwanted mineral in an aqueous slurry are treated with a collector prior to the addition of a frother and flotation of the desired mineral particles in a froth flotation cell characterised in that after treatment with the collector a predominantly hydrophobic non-water soluble polymeric flocculating agent which will selectively flocculate the desired mineral particles is added to the slurry.

Suitable predominantly hydrophobic polymers which will selectively flocculate particles of a desired mineral already rendered hydrophobic by treatment with a collector include polyvinyl ethers, such as polyvinyl ethyl ether or polyvinyl isobutyl ether and polybutadienes. Polyvinyl ethers are preferred.

To be useful in the process of the invention the polymer must be dispersible in water. If the polymer is a liquid it can either be dispersed directly in the aqueous suspension of mineral particles or predispersed in a carrier liquid, such as the frother. If the polymer is a solid it must be predispersed in a carrier liquid. If desired a dispersant may be used to aid dispersion of the polymer.

The collector which is used to render the mineral particles hydrophobic prior to the addition of the selective flocculating agent may be any of the collectors conventionally used in the beneficiation of mineral particles by a froth flotation process. Such collectors are generally heteropolar surface active compounds. The polar portion of their molecules attaches to the surface of the desired mineral particles and the hydrocarbon tail of the collector molecules renders the the surfaces hydrophobic. Although collectors may be relatively high molecular weight compounds, they are not usually polymeric.

The selective flocculating agent may be added prior to, after or together with the frothing agent but is preferably added in the form of an additive composition containing both the selective flocculating agent and the frothing agent. The selective flocculating agent may be used in conjunction with any of the known frothing agents used in the froth flotation of minerals, for example, a propoxylated butanol.

The selective flocculating agent is preferably used in an amount not greater than 50 g per tonne of total mineral solids in the aqueous slurry and is more preferably used at a rate of 3–8 g per tonne of total mineral solids. Alternatively, expressed in terms of the desired mineral the selective flocculating agent is preferably used in an amount not greater than 500 g/tonne of the desired mineral and is more preferably used at a rate of 20–80 g per tonne of the desired mineral.

Varying the dosage rate of the selective flocculating agent may vary the balance between the purity of the mineral recovered (concentrate grade) and the quantity of mineral recovered (percentage recovery).

The selective flocculating agent may be used as a replacement for part of the quantity of frothing agent which is normally used in froth flotation.

In the beneficiation of copper sulphide minerals, for example, the recovery of copper from an ore containing 1.0 to 1.6% by weight copper in sulphide form (mainly chalcocite) was increased by between 14 and 18% when between 10 and 25% by weight of the polypropylene glycol frother used was replaced by polyvinyl ethyl ether. In the normal grinding process which precise flotation, some of the chalcocite, which is both dense and soft, is ground finer (probably less than 5 microns) than the normally considered optimum particle size for flotation because it is ground in preference to harder minerals of lower density. These ultra fine copper sulphide particles are rendered hydrophobic by the addition of a collector such is sodium isopropyl xanthate, but they cannot be recovered by froth flotation simply by the addition of a frother because being so fine they cannot penetrate the air bubbles and attach themselves to the air inside, probably because they are swept aside by the water flow around the bubbles. When a predominantly hydrophobic polymer is added in addition to the frother the polymer is selectively adsorbed on to the collector coated hydrophobic ultra fine particles and the particles flocculate together. The flocculated particles can then penetrate the air bubbles and attach themselves to the air inside during flotation and are recovered.

In the beneficiation of oxidised copper minerals, principally malachite, for example, using the process of the invention, improved recovery of the mineral particles is obtained, but the degree of improvement is not as marked as in the case of sulphide minerals because malachite is relatively hard and during grinding less ultra fine particles are produced.

The process of the invention offers a number of advantages. As a result of the flocculation of the desired mineral particles fine particles present are recovered faster and more efficiently with less water in the froth and with less contamination by undesirable slimes which are suspended in the water. Recovery of desired mineral particles at the coarse end of the size range may also be improved, possibly as a result of coagulation of coarse, medium and fine particles together with small air bubbles, or possibly simply because the hydrophobicity of the coarser particle surfaces is increased.

The process of the invention may be applied to any mineral whose particles have been rendered hydrophobic, but it is of particular value in the froth flotation of fine-grained mineral ores whether they be base metal sulphides, phosphate rocks, or any other mineral whose processing by froth flotation is subject to sliming problems. The potential benefit of the process is related to the degree of overgrinding or sliming which has occurred during grinding of the ore being greater the greater the quantity of ultra fine particles there are present.

In addition to the process of beneficiation of mineral particles described above, the invention also includes an additive composition for use in the process comprising a frothing agent and a predominantly hydrophobic polymeric flocculating agent capable of selectively flocculating the particles of a desired mineral.

The following examples will serve to illustrate the invention.

EXAMPLE 1

A standard froth flotation process and the process of the invention were applied to a complex copper ore containing between 1.0 and 1.6% by weight copper in sulphided form (assayed as acid insoluble copper, AICu) and between 1.2 and 1.8% by weight copper in oxidised form (assayed as acid soluble copper, ASCu). The principal copper sulphide mineral present was chalcocite and the principal oxidised copper mineral present was malachite. Other copper minerals present in lesser proportions included covellite, bornite, chalcopyrite and azurite.

The ore was ground in water until 80% by weight was of a particle size less than 100 microns. This grinding was sufficient to liberate particles of copper minerals adequately from the waste rock and render the particles small enough to be recovered by froth flotation. However, such grinding resulted in an appreciable proportion of the relatively soft chalcocite and covellite minerals having a particle size of less than 5 microns and such ultra fine particles respond very slowly if at all to a subsequent standard flotation stage. Some of the harder malachite was also reduced in size to the ultra fine range with a similar effect on its flotation recovery rate using a standard flotation technique.

In the standard procedure, the pulp after grinding, containing 30 to 33% by weight solids, was conditioned for 2 minutes with 100 g/tonne of a sodium isopropyl xanthate collector. 30 g/tonne of a polypropylene glycol frother were added, the pulp was aerated, and the copper sulphides were floated for a period of 6 minutes. The froth, termed sulphide rougher froth, contained 19% by weight AICu and recovered about 75% by weight of the AICu.

500 g/tonne of sodium hydrogen sulphide were added to the tailing from the sulphide rougher flotation and the tailing was conditioned for 2 minutes. 30 g/tonne of a polypropylene oxide adduct of butanol as frother were added and also 100 g/tonne of a diesel fuel oil collector. The tailing pulp was aerated and the oxidised copper minerals, mainly malachite, were floated for 8 minutes. The froth, termed oxide rougher froth, contained12% by weight ASCu and recovered about 63% by weight of the ASCu.

When prior to the sulphide roughing, 15% by weight of the polypropylene glycol frother was replaced with a polyvinyl ethyl ether (available under the trade name LUTONAL A25) the recovery of AICu was increased to about 90% by weight, with little or no lowering of the froth grade.

When ahead of the oxide roughing 15% by weight of the polypropylene oxide adduct of butanol was replaced with LUTANOL A25 polyvinyl ethyl ether, the recovery of ASCu was increased to 66% by weight and the froth grade remained at12%. by weight ASCu.

EXAMPLE 2

On the tailings of a copper sulphide flotation containing approximately 0.7% by weight copper, mostly in the form of acid-soluble or oxidised copper minerals (malachite and azurite) a copper oxide float was performed with the usual sulphidisation of the oxidised copper minerals, followed by treatment with a xanthate collector.

In one test 30 g/tonne of a propoxylated butanol frothing agent was used as frother and gave a rougher flotation froth containing 9.0% by weight of acid-soluble copper and a recovery of 63.5% by weight of the acid-soluble copper minerals present in the tailings.

In a second test 30 g/tonne of an additive consisting of 75% by weight of the propoxylated butanol frothing agent and 25% by weight of a LUTANOL A25 polyvinyl ethyl ether was used and gave a rougher flotation froth containing 9.0% by weight acid-soluble copper and a recovery of 71.9% by weight of the acid-soluble copper minerals present in the tailings.

EXAMPLE 3

An additive consisting of 90% by weight of propoxylated butanol frothing agent and 10% by weight of polyvinyl ethyl ether (LUTANOL A25) was used in the flotation of copper sulphide flotation tailings treated as described in Example 2 at the rate of 30 g/tonne. The grade of the rougher flotation froth was 9.4% by weight acid-soluble copper and the recovery obtained was 69.5% by weight of the acid-soluble copper minerals present in the tailings.

I claim:

1. In a froth flotation process for the beneficiation of mixed mineral particles containing a noncarbonaceous first mineral and a second mineral in which particles of said first mineral which it is desired to recover and particles of said second which it is not desired to recover in an aqueous slurry are treated with a collector for said first mineral prior to the addition of a frother and flotation of the mixed mineral particles in a froth flotation cell wherein the first mineral is selectively concentrated in the froth the improvement comprising adding to the slurry a collector which renders hydrophobic the surfaces of the first mineral particles which it is desired to recover, and then, after said collector addition and prior to the flotation, adding a predominantly hydrophobic non-water soluble polymeric flocculating agent which will selectively adsorb onto the hydrophobic surfaces of said first mineral particles so-formed and flocculate the particles of the first mineral together.

2. A process according to claim 1 wherein the predominantly hydrophobic non-water soluble polymeric flocculating agent is a polyvinyl ether or a polybutadiene.

3. A process according to claim 2 wherein the polyvinyl ether is polyvinyl ethyl ether or polyvinyl isobutyl ether.

4. A process according to claim 1 wherein the predominantly hydrophobic non-water soluble flocculating agent is dispersed in a carrier liquid prior to addition to the aqueous slurry.

5. A process according to claim 4 wherein the carrier liquid is a frother.

6. A process according to claim 5 wherein the frother is polypropylene glycol or a polypropylene oxide adduct of butanol.

7. A process according to claim 1 wherein the predominantly hydrophobic non-water soluble polymeric flocculating agent is used in an amount of up to 500 g/tonne of the first mineral.

8. A process according to claim 7 wherein the predominantly hydrophobic non-water soluble polymeric flocculating agent is used in an amount of 20–80g/tonne of the first mineral.

9. A process for the beneficiation of mixed mineral particles containing a noncarbonaceous first mineral and a second mineral, said process comprising the steps of:

treating said mixed mineral particles in an aqueous slurry with a collector for said first mineral which renders hydrophobic the surfaces of the first mineral particles which it is desired to recover, said collector being added prior to addition of a frother;

adding to the slurry, after treatment with the collector, a predominantly hydrophobic non-water soluble polymeric flocculating agent which will selectively adsorb onto the hydrophobic surfaces of said first mineral so-formed and flocculate the first mineral particles together; and subjecting to flotation in a forth flotation cell the mixed mineral particles containing flocculated first mineral particles and second mineral particles wherein the flocculated first mineral particles are selectively concentrated in the froth.

10. A process according to claim 9 wherein the predominantly hydrophobic non-water soluble polymeric flocculating agent is a polyvinyl ether or a polybutadiene.

11. A process according to claim 10 wherein the polyvinyl ether is polyvinyl ethyl ether or polyvinyl isobutyl ether.

12. A process according to claim 9 wherein the predominantly hydrophobic non-water soluble flocculating agent is dispersed in a carrier liquid prior to addition to the aqueous slurry.

13. A process according to claim 12 wherein the carrier liquid is a frother.

14. A process according to claim 13 wherein the frother is polypropylene glycol or a polypropylene oxide adduct of butanol.

15. A process according to claim 9 wherein the predominantly hydrophobic non-water soluble polymeric flocculating agent is used in an amount of up to 500 g/tonne of the first mineral.

16. A process according to claim 15 wherein the predominantly hydrophobic non-water soluble polymeric flocculating agent is used in an amount of 20–80 g/tonne of the first mineral.

* * * * *